US005103597A

United States Patent [19]

Courchesne

[11] Patent Number: 5,103,597

[45] Date of Patent: Apr. 14, 1992

[54] BLADE SHARPENING DEVICE

[76] Inventor: Richard L. Courchesne, 3931 Sherwood Blvd., Delray Beach, Fla. 33445

[21] Appl. No.: 538,542

[22] Filed: Jun. 14, 1990

[51] Int. Cl.[5] ..... B21K 17/00

[52] U.S. Cl. ..... 51/205 R; 51/205 WG; 51/211 R; 51/214; 76/83; 76/88

[58] Field of Search ..... 76/88, 83, 85, 86; 51/211 R, 204, 205 R, 205 WC, 214, 211 H, 181 R

[56] References Cited

U.S. PATENT DOCUMENTS

| | | | |
|---|---|---|---|
| 471,164 | 3/1892 | Young | 76/83 |
| 555,974 | 3/1896 | Roberts | 76/83 |
| 1,006,000 | 10/1911 | Oosdyke | 76/83 |
| 1,324,512 | 12/1919 | Maurer | 51/214 |
| 1,818,870 | 8/1931 | Rice | 51/205 WG |
| 4,777,770 | 10/1988 | LeVine | 51/205 WG |
| 4,815,240 | 3/1989 | Larson | 51/205 WG |

FOREIGN PATENT DOCUMENTS

| | | | |
|---|---|---|---|
| 265919 | 4/1950 | Switzerland | 51/205 WG |

*Primary Examiner*—Bruce M. Kisliuk

*Assistant Examiner*—John Addison Marlott

*Attorney, Agent, or Firm*—Jack E. Dominik

[57] ABSTRACT

A blade sharpener which has two elements, one of which is a hand-held member, and the other of which is a follower member is disclosed. The two members are pivotally secured each to the other, and secured at variable preselected pivot points so that adjustments can be made for the particular skate, and for the particular cross-section of the blade desired at various points along the power toe section, neutral under foot section, and turning heel section. Means are provided interiorly of the two members to optionally secure a file or a neutral member such as a wooden dowel to the end that varying portions of the blade can be sharpened while moving the hand-held member back and forth longitudinal of the blade. Guide means are supplied on both members for securing the relationship of the file or abrading member to the blade in a preselected centralized orientation. The method of the invention contemplates sharpening a blade by longitudinally stroking the same with files having various cross-sections which are guided in fixed relationship to the blade to thereby develop the desired cross-section or cut of the blade at various points along its length.

4 Claims, 3 Drawing Sheets

BLADE SHARPENING DEVICE

1. Field of the Invention

The present invention relates to a device and method for sharpening blades. It has particular utility in the sharpening of blades for use on hockey skates, but is also applicable for other type ice skating blades and blades such as those for ice boats, bob sleds, and the like.

2. Summary of the Prior Art

Most techniques for sharpening blades involve a grinding wheel of some sort. Such grinding wheels are made up of fine particles of corundum bonded and pressed together with a grinding profile of the desired blade cut. In certain instances, a jig is employed, and the blade is moved coaxially with the axis of the blade. While this imparts a curved or slightly undercut configuration to the blade, it is generally uniform throughout the entire length of the blade. In this context, it is highly desirable to develop a blade sharpening apparatus and method which moves longitudinally of the blade, and which can be adapted to develop different depth and different profile cuts along the length of the blade including the power toe section, the neutral under foot section, and the turning heel section. In addition, it is highly desirable to stroke the blade longitudinally so that whatever roughness, scarifying, or striations result they are parallel with the path of the blade and therefore will be of minimal resistance as the blade crosses the ice.

SUMMARY OF THE INVENTION

The present invention involves a blade sharpener which has two elements, one of which is a hand-held member, and the other of which is a follower member. The two members are pivotally secured each to the other, and secured at variable preselected pivot points so that adjustments can be made for the particular skate, and for the particular cross-section of the blade desired at various points along the power toe section, neutral under foot section, and turning heel section. Means are provided interiorly of the two members to optionally secure a file or a neutral member such as a wooden dowel to the end that varying portions of the blade can be sharpened while moving the hand-held member back and forth longitudinally of the blade. Guide means are supplied on both members for securing the relationship of the file or abrading member to the blade in a preselected centralized orientation. The method of the invention contemplates sharpening a blade by longitudinally stroking the same with files having various cross-sections which are guided in fixed relationship to the blade to thereby develop the desired cross-section or cut of the blade at various points along its length.

In view of the foregoing, the primary object of the present invention is to provide a means and method for sharpening blades which permits significant variation along the longitudinal length of the blade of the cross-section of the sharpened blade. A related object of the present invention is to achieve the foregoing while stroking the blade with the abrading member, such as a file, along the length of the blade to the end that any rough lines along the sharpened edge are oriented along the longitudinal axis of the blade.

A related but important object of the present invention is to provide an apparatus for sharpening blades which will achieve the above objectives and which is inherently economical to build, and sufficiently simple in structure that the sharpener can develop techniques for securing a desired cross-section of the blade at a wide variety of locations with a wide variety of cross-sections.

BRIEF DESCRIPTION OF THE ILLUSTRATIVE DRAWINGS

Further objects and advantages of the present invention will become apparent as the following description of an illustrative embodiment and method proceeds, taken in conjunction with the accompanying drawings, in which.

Figure 12:
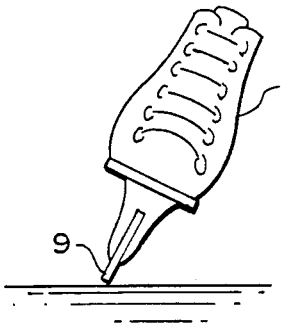
Figure 13:
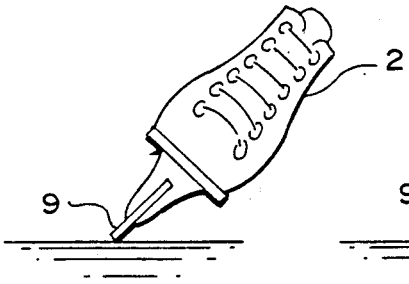
Figure 14:
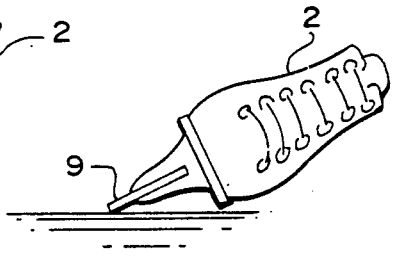
Figure 15:
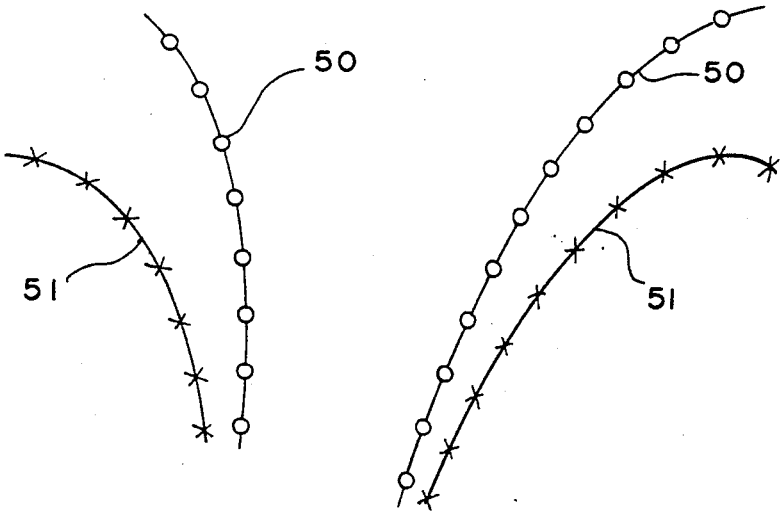

FIGS. 12, 13, and 14 show the various angular relationships of a skate blade with the ice as the skater is striding, turning, or in a hard turn or a stop; and FIG. 15 shows comparative stride patterns achieved by skates sharpened in accordance with the present invention, and skates sharpened in accordance with the prior art.

DESCRIPTION OF A PREFERRED EMBODIMENT

Figure 1:
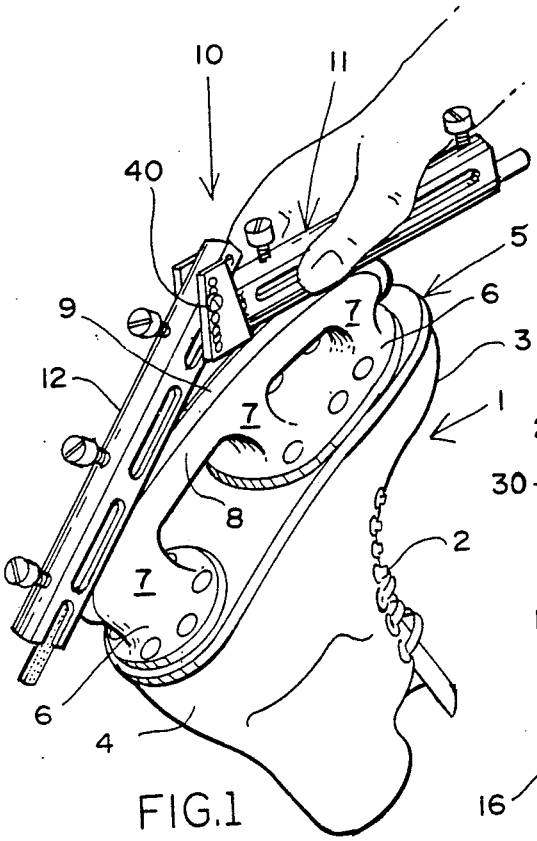
FIG. 1 is a perspective view of a typical ice skate of the hockey variety showing the hand of the user secured to the sharpener on the hand-held member, and showing the pivotal relationship between the hand-held member and the follower member.
Figure 2:
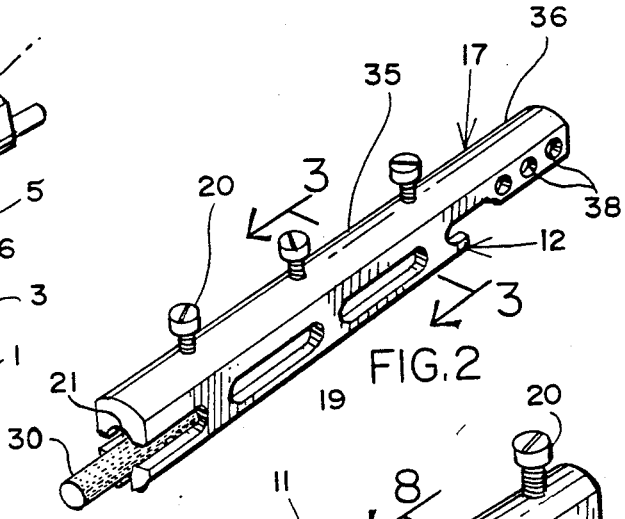
FIG. 2 is a perspective view of the follower member.

In the embodiment shown, a mechanism and method are described for sharpening an ice skate of the hockey skate variety. Turning now to FIG. 1, it will be seen that the ice skate 1 includes a shoe portion 2 having a toe 3 and a heel 4. A blade mount 5 is provided with a pair of shoe pads 6 and extending therefrom are blade posts 7. A blade grip 8 portion of the blade mount 5 secures the blade 9 in position.

The sharpener 10 includes a hand-held member 11 and a follower member 12. The hand-held member 11, as shown in FIG. 1, is illustrated when gripped by the right hand of the person sharpening the blade.

Figure 4:
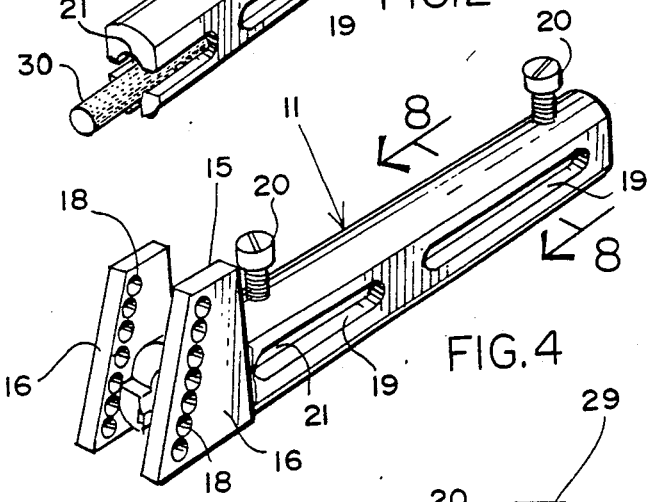
FIG. 4 is a perspective view of the hand-held member.
Figure 3:
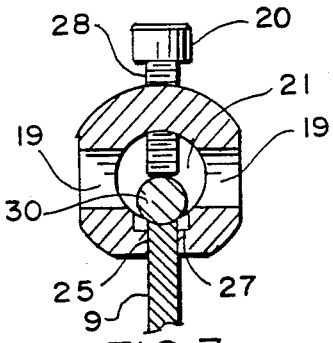
FIG. 3 is a transverse sectional view of the follower member taken along section line 3—3 of FIG. 2.
Figure 8:
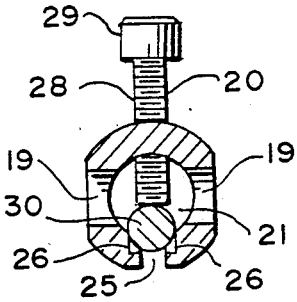
FIG. 8 is a transverse sectional view of the hand-held member taken along section line 8—8 of FIG. 4.
Figure 9:
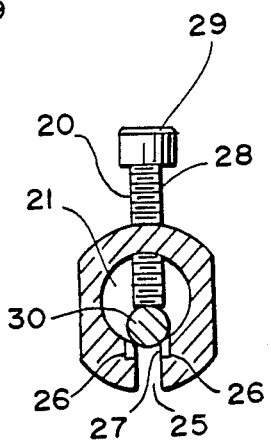
FIG. 9 is a transverse sectional view of the hand-held member taken along section line 9—9 thereof as shown in FIG. 6.

Turning now to FIG. 4, it will be seen that the hand-held member 11 has a hand-held member body 14 with an adjustable pivot 15 at one end thereof. The adjustable pivot 15 is formed by a pair of parallel pivot posts 16. Each of the pivot posts 16 have a plurality of opposed pivot holes 18. The body 14 has a plurality of opposed side slots 19. Gripper bolts 20 are provided through threaded bolt holes (not shown) in the hand-held member body 14 and penetrate the hollow bore 21 where they can secure either an inert member, or an abrading member for purposes of sharpening. In FIG. 3, means are shown provided to define a blade slot 25 in the hand-held member 11. Relief groove 27 is provided in the upper portion of the jaws 27 which define the blade slot 25. The grooves will collect the filings or swarf as metal is removed from the blade 9. As shown in FIG. 3, a blade 9 is being sharpened by a round file 30. As shown in FIG. 8, where no blade is present, the round element shown as file 30 is secured and oriented by means of clamp jaws 26. The round member 30 as shown in both FIGS. 3 and 8 has a gripper threaded body portion 28, and a gripper hand operated head 29.

Figure 5:
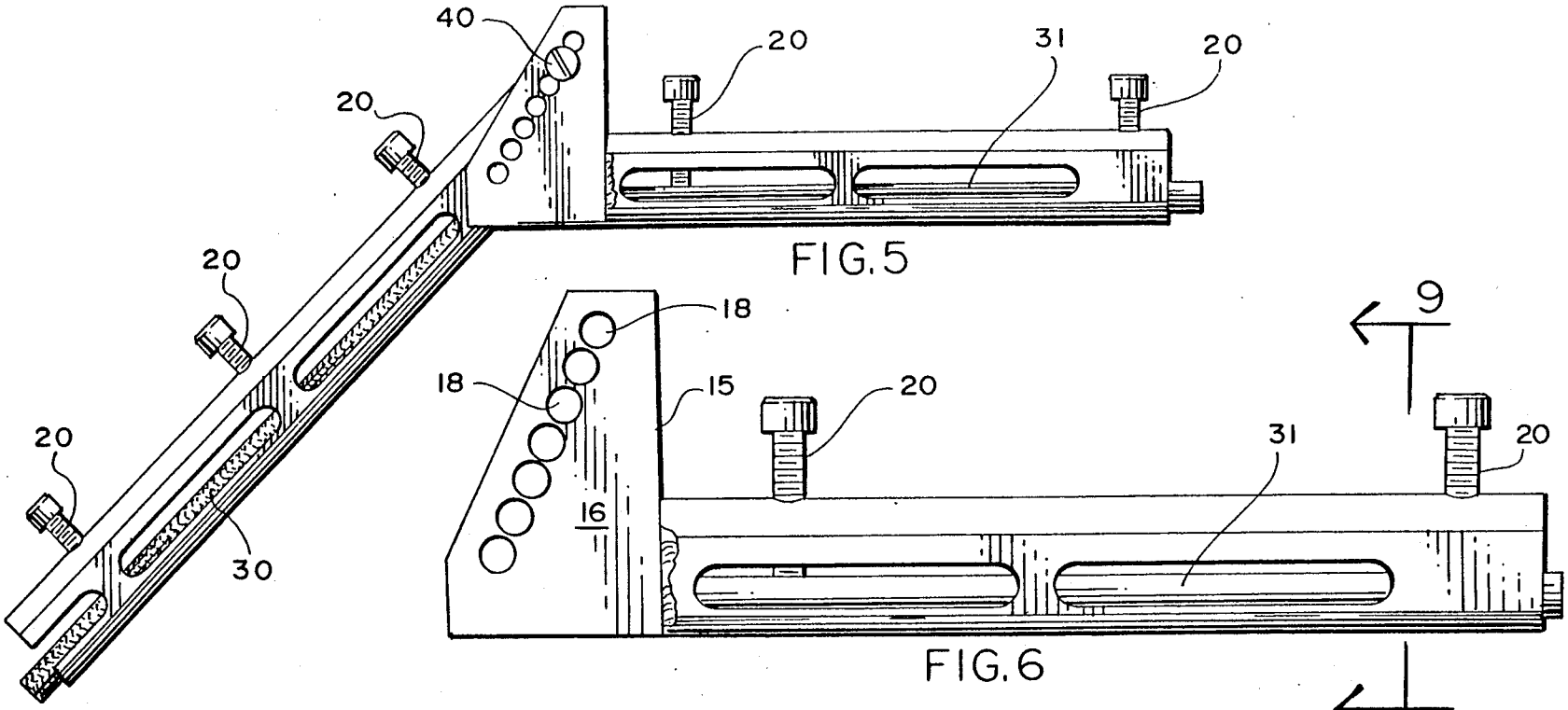
FIG. 5 is an enlarged front elevation of the sharpener showing the hand-held member and the follower member in pivotal relationship each to the other.
Figure 6:
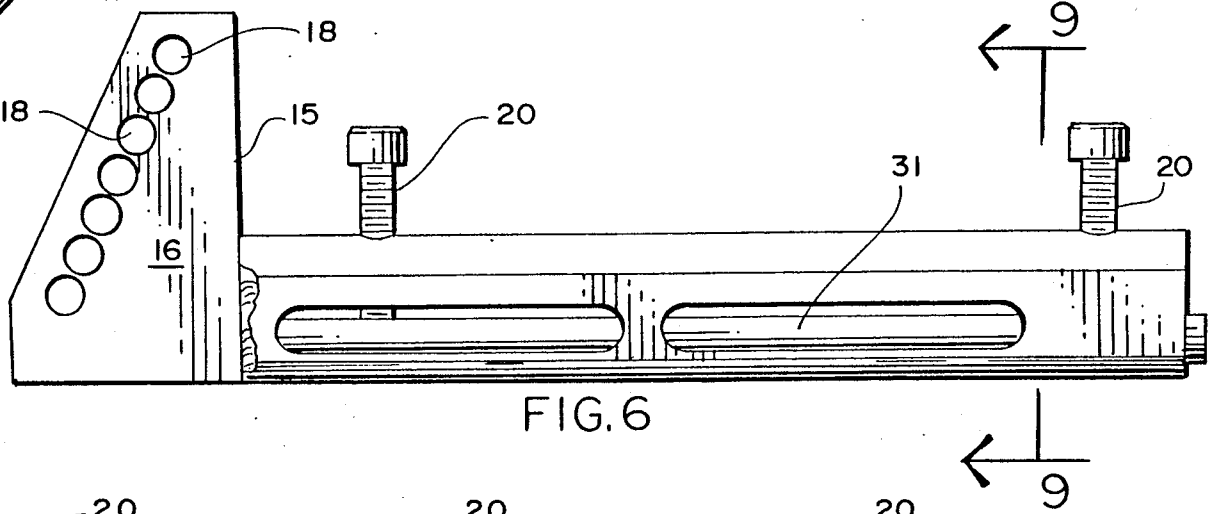
FIG. 6 is a front elevation of the hand-held member only and showing the plurality of pivot holes.
Figure 7:
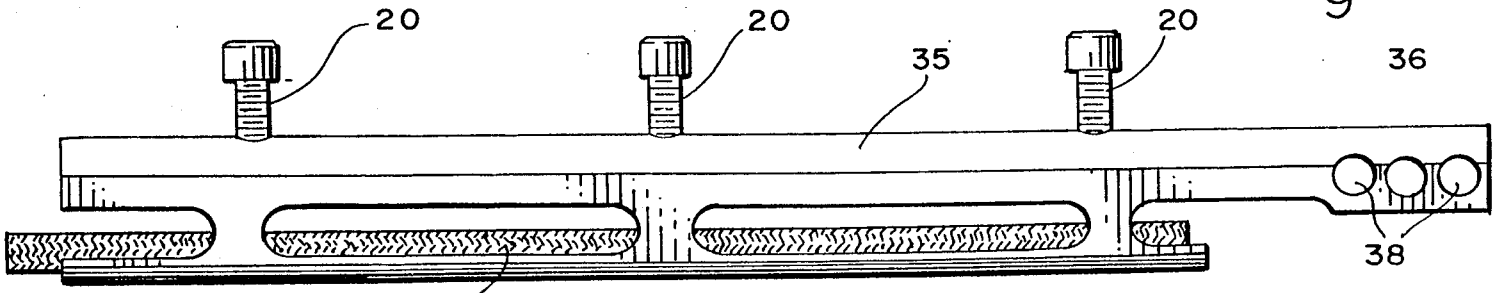
FIG. 7 is a front elevation of the follower and showing the adjustable pivot holes at its right end portion.
Figure 11:
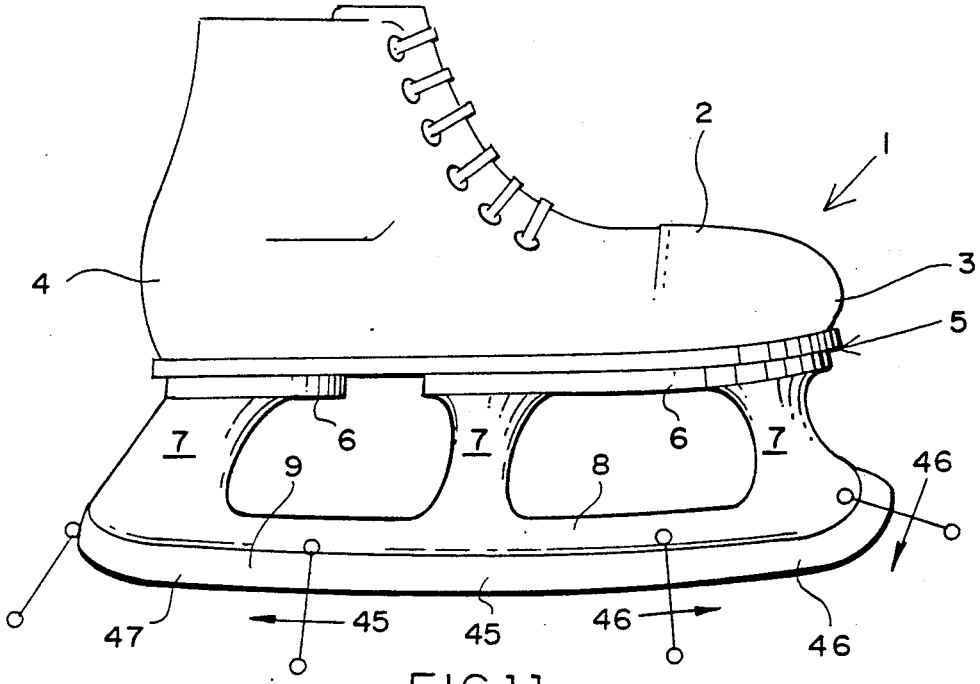
FIG. 11 is a front elevation of a typical skate illustrating the elements of the blade in their various sectors being the power sector at the toe, the neutral section under the foot, and the turning or stopping section beneath the heel.

Turning to FIGS. 5, 6 and 7, it will be seen that either a file 30 or an inert round member 31 may be secured in the hollow body portion 21. This is true for both the hand-held member 11 and the follower member 12. To be noted also in FIGS. 5, 6 and 7, the follower body 35 has follower adjustable pivot 36 with adjustable pivot holes 38, as shown here, three in number. Because the follower holes 38 can be pivotally adjusted longitudinally, and because the pivot holes 18 of the adjustable pivot 15 are shown as seven in number, a wide variety of angular relationships can be developed between the hand-held member 11 and the follower member 12 as the same pass back and forth over the blade 9. It will be appreciated that the hand-held member 11, when a file 30 is mounted therein, sharpens the neutral zone of the skate as shown in FIG. 11 by reference numeral 45. This can be best observed in connection with FIG. 1, where it will be seen that the follower 12 is rounding over the turning zone 47 at the heel, but upon reversal of the sharpener 10, the same will be rounding the power zone 46 of the toe. Thus the three basic elements of the blade 9, namely the neutral zone 45, power zone 46, and turning zone 47 can all be sharpened and in addition, when the power zone 46 and turning zone 47 are sharpened, the hand-held member 11 can be provided with a neutral core 31 such as a wooden dowel to protect its blade edge which has already been sharpened.

The results are quite dramatic as illustrated in FIGS. 12, 13 and 14. The sharp edge coupled with the ability to power the stride, and dig in deep on turning or stopping, gives the skater an opportunity to lean to extreme positions without risking losing an edge or falling. Typical of the stride pattern which can be obtained by the subject method, it will be seen in FIG. 15 that the method stride 50 is a slightly curved line. Alternatively, with the prior art-type blade and method of sharpening, the prior-art stride 51 is marked by significant curvature.

Figures 10A, 10B, 10C, 10D, 10E:
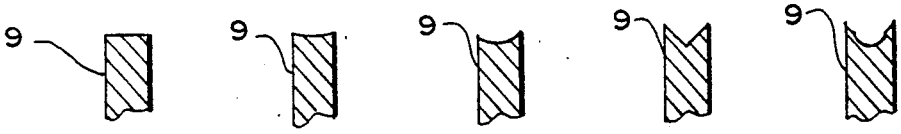
FIG. 10 is a typical blade cross-section with various sharpening patterns as illustrated by elements A, B, C, D, and E, of FIG. 10.

Finally, the illustrative cross-sections of the blade sharpening zone are shown in FIG. 10. In FIGS. A and B relatively shallow cuts are made which will be typical of the neutral zone 45. On the other hand deeper cuts such as 10C can be used in the power zone 46 or, indeed, a V-type cut as shown in FIG. 10D can be used there as well. The double cut as shown in FIG. 10E is primarily reserved for the turning zone 47, but at the option of the skater or sharpener can be applied at any position along the neutral zone 45, power zone 46, or turning zone 47.

THE METHOD

The method is primarily directed to sharpening a blade by longitudinal strokes of a round abrading member such as a round file. Various pre-selected diameters may be employed in a jig which secures the abrading member in opposed relationship to the surface to be sharpened by means of parallel guide faces. Because a hand-held member and follower member are employed, the sportsman or skater may apply the type of cut desired at the place it is desired. This is just as true with an ice boat blade, or a bob sled blade, or a racer skate blade.

The neutral zone does not require a very deep edge. The function of the neutral zone is to prepare or guide into the power mode, turning mode, or stopping mode. It is also used at the beginning of a declaration of position or stopping. This edge is obtained by the hand-held member.

The power mode needs a deeper edge than the neutral part of the blade. Two forces can be provided in the power mode, downward for one-half of the stride, and inward for the balance of the stride. The force of the downward portion can be two or three times more than that on the neutral portion of the blade, so more edge is required to true the line and achieve better balance. Inward or lateral forces exist at the end of stride motions and if a deep edge is not present at this point, the front of the skate can point outwardly losing power downwardly and inwardly and no more speed can be achieved. By using the present edge, this will be corrected by providing a deeper edge in the power mode of the blade and applying the same gradually.

The turning mode at the back of the blade has downward forces sometimes three to five times more than the neutral zone and twice as much as the power zone. The edge at this point needs to be the deepest of the entire blade. To achieve peak performance in the turning section a file of the smallest radius is inserted to make sure that the deepest penetration of the blade is made. The hand-held portion is reciprocated with the small round file in the follower, and the turning portion is achieved.

It is always possible to blend the deep cuts of the power portion and the turning portion by varying the pivotal connection between the hand-held member and the follower member, and also changing the files to a larger diameter in the area where the power edge or the turning edge blend in with the neutral zone.

In the crossover mode of skating, the skater can lean more in the inside and the power turning edge creates a deflection in the blade the further he leans and therefore gives a positive grip to the ice and permits the skater to build up more speed as he turns faster and this, therefore, will permit skating in the crossover mode to achieve a smaller radius of turn.

As to the selection of files, the round files are good in the front and rear sections and should have diameters of one-eighth to one-half inch. A flat file can be employed in the neutral zone. Oval files can also be employed in the neutral zone and in the blending areas between the neutral zone and the power zone and turning zone. A triangular file is good to provide the lateral force in the power zone and turning modes in extreme positions. The double edge may be selectively used in both the power zones and the turning zone. The foregoing are guide lines, recognizing the each skater and each sportsman will fine tune his own blade for his own application in accordance with practical performance.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A blade sharpener comprising, in combination, a hand-held member, a follower member, said hand-held member having adjustable pivot means oriented along an angle with body portion, and said body portion having means for retaining an abrading member or neutral member therein, said body portion having orienting members positioned to engage a blade, said follower member having a body portion and means to engage a blade, said follower member body portion having means for receiving an abrading member or a neutral member, said follower having pivotal means at one end thereof, and means for pivotally coupling the hand-held member to the follower member including pivot engaging means for securing the hand-held member adjustable pivot means with the follower pivotal means.

2. In the sharpener of claim 1, said follower member having a plurality of pivotal means.

3. In the sharpener of claim 1, said hand-held member having a plurality of adjustable pivot means.

4. In the sharpener of claim 1, said orienting member for engaging a blade being in parallel spaced relation to the abrading means and proportioned to flank a blade.

* * * * *